US005603172A

United States Patent [19]

Maher

[11] Patent Number: 5,603,172

[45] Date of Patent: Feb. 18, 1997

[54] SELECTIVELY REVERSIBLE RESILIENT PLOW BLADE AND KIT

[76] Inventor: Richard J. Maher, 103 Park St., Tilton, N.H. 03276

[21] Appl. No.: 337,764

[22] Filed: Nov. 14, 1994

[51] Int. Cl.[6] ..... E01H 5/04

[52] U.S. Cl. ..... 37/233; 37/234; 37/266; 172/794; 172/819

[58] Field of Search ..... 37/233, 232, 234, 37/235, 236, 240, 266, 460, 446, 270, 271; 172/794, 818, 819, 811, 820

[56] References Cited

U.S. PATENT DOCUMENTS

| | | | |
|---|---|---|---|
| 1,519,249 | 12/1924 | Friedman . | |
| 1,655,136 | 1/1928 | Criley . | |
| 2,657,481 | 11/1953 | Larsen | 37/124 |
| 3,007,265 | 11/1961 | Harris | 172/802 |
| 3,238,648 | 3/1966 | Cobb et al. . | |
| 3,477,151 | 11/1969 | Zanella . | |
| 3,774,696 | 11/1973 | Horsch | 172/812 |
| 3,775,877 | 12/1973 | Gove, Sr. | 37/233 |
| 3,793,752 | 2/1974 | Snyder | 37/233 X |
| 3,808,714 | 5/1974 | Reissinger et al. | 37/233 |
| 3,853,181 | 12/1974 | Yoshizaki | 172/820 |
| 3,947,981 | 4/1976 | Shore | 37/416 |
| 4,006,782 | 2/1977 | Nishino et al. . | |
| 4,019,587 | 4/1977 | Meisel, Jr. . | |
| 4,023,362 | 5/1977 | Rögner et al. | 60/347 |
| 4,120,364 | 10/1978 | Wooldridge | 172/2 |
| 4,225,878 | 3/1981 | Mähler et al. . | |
| 4,254,564 | 3/1981 | Rath . | |
| 4,259,794 | 4/1981 | Rath . | |
| 4,692,028 | 9/1987 | Schave | 366/22 |
| 5,025,577 | 6/1991 | Verseef . | |

*Primary Examiner*—Terry Lee Melius
*Assistant Examiner*—Victor Batson
*Attorney, Agent, or Firm*—Stephen G. Matzuk

[57] ABSTRACT

A plow blade comprising a forward facing longitudinally curved major portion and a minor blade resiliently and pivotally mounted on the major portion and being disposed between the major portion and the surface to which the plow is applied. Also included in the preferred embodiment is a 'reversing' cylinder which is selectably operable to apply a force to urge the minor blade into a selectably rearward angle without inhibiting the resilient movement of the lower portion to respond to surface obstacles by deflecting into a further rearward position. Also provided of the present invention are selectable intermediate minor blade positions, such as perpendicular to the surface, to facilitate removal of residual surface material, e.g. packed snow and ice. Alternate embodiments include a retrofit kit applicable to existing plows to provide the features of the present invention.

16 Claims, 7 Drawing Sheets

SELECTIVELY REVERSIBLE RESILIENT PLOW BLADE AND KIT

FIELD OF THE INVENTION

The present invention relates to plow blades, in particular to plow blades having multiple individually positionable longitudinal portions which are configurable to provide plowing action in forward and reverse directions.

BACKGROUND OF THE INVENTION

The vehicle-mounted plow used for snow and light earth plowing is typically configured with a forwardly oriented concave longitudinally curved plow with its lower surface contacting the surface to which it is applied with an acute angle significantly less than 90°. In tight plowing locations such as in front of a locked garage door or in a dead end or a corner, it is desirable to move the snow or earth while travelling in a reverse direction to back drag snow or soil without reversing the direction of the entire vehicle. It is also desirable to completely remove the snow from the surface, leaving no residual layer on the surface, which through succeeding accumulations, build up forming icy ridges, uneven surfaces, or other dangerous situations. However, the low angle with which the plow blade meets the surface in the forward direction to separate and lift the snow or gravel from the surface now causes the plow to glide over the surface when moving in the reverse direction, displacing little of the snow or gravel.

Smaller plow blades used for residential or light plowing typically incorporate a lower portion forming a minor blade, typically called a 'trip edge' (or base angle), interposed between the main portion of the plow and the surface to be plowed, wherein the minor blade is typically resiliently pivoted on the lower portion of the main blade to swing rearward in the event of striking a rock or other relatively unmovable protrusion while moving in the forward direction, thus preventing the entire force of the plow vehicle to bear on the plow blade at that point. Thus, the normal operating position of the lower portion is in the forward position, moving rearward only in response to the occasional obstructions on the surface and thus being relatively ineffective in moving snow or soil behind the trip edge.

SUMMARY OF THE INVENTION

The preferred embodiment provides selective actuation of the typical spring-loaded trip edge into a reverse direction by a hydraulic 'reversing' cylinder for plowing snow and light grading of soil or gravel in a direction opposite to normal plow operation. Moreover, the reversing cylinder is powered by the same hydraulic source typically used to position the plow on the front of the truck or other vehicle and is selectively powered by an auxiliary valve in the hydraulic circuit controlled by the plow operator. An embodiment of the present invention may be retro-fitted over existing plow structure, which when not actuated, does not interfere with the common functions of the snow plow and the trip blade.

The present invention is also embodied as a compact kit of light weight components to retro-fit existing plows which typically include resiliently pivoted lower blade portions, to provide the features of the present invention without requiring purchase of an entirely new plow blade or sacrificing the existing plow blade functions. Moreover, the present invention is applicable to plows of increased width by including additional reversing cylinders across the width of the plow.

Thus, the plow according to the present invention provides a snow plow blade or blade retro-fit kit which significantly increases the utility of the plow by providing the ability to plow while moving in the reverse direction (and/or perpendicular or other intermediate angle) relative to the surface.

BRIEF DESCRIPTION OF THE DRAWING

These and further features of the present invention will be better understood by reading the following Detailed Description together with the Drawing, wherein.

DETAILED DESCRIPTION OF THE PRESENT INVENTION

Figure 1:
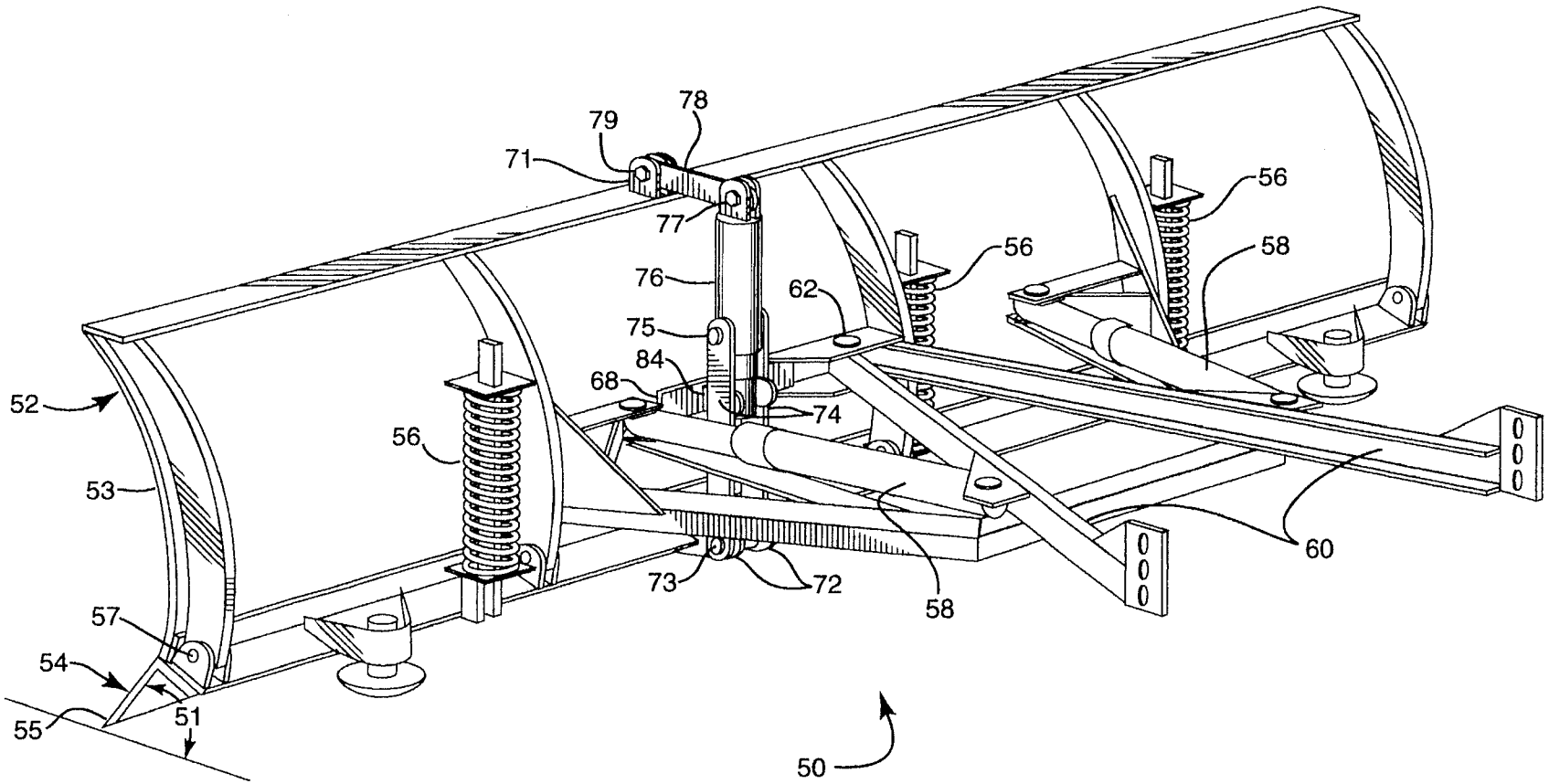
FIG. 1 is a perspective view of a plow according to one embodiment of the present invention having a single reversing cylinder.

A rear isometric drawing of the plow according to one embodiment of the present invention is shown in FIG. 1, wherein the plow includes a major blade 52 and a minor blade, or trip edge, 54. The trip edge 54 is pivotally mounted on the major blade portion 52 along the bottom of the major blade portion by pivot pins 57 and rides over the surface to be plowed and presents an acute angle 51 with the surface in the normal, untripped mode. The trip edge is resiliently positioned by one or more compression springs 56, having ends connected to the major and minor (trip edge) blade portions, to urge the forward surface 55 of the trip edge 54 to be substantially continuous with the forward surface 53 of the major blade portion 52 to form a forward facing, longitudinally oriented substantially concave plow front surface. The plow is mounted on the front of a driving vehicle (not shown) by frame 60 and pivots about a vertical axis on pivot 62 according to the extension or contraction of left/right control cylinder 58; a second left/right control cylinder is also present on the opposite side of frame 60 symmetrical with the cylinder 58 about the pivot 62.

According to one embodiment of the present invention, the trip edge 54 is selectively actuated by attached rearward extending linkages 72 and linkages 74A which are pivotally connected by pins. The linkages 74A connect to and are pivotally connected to pins 75A mounted on the opposite of a cylindrical tube 76 which is moved by a hydraulic 'reversing' cylinder mounted within the cylindrical tube 76, and described in greater detail below. The cylindrical tube 76 is guided to move along a generally linear direction with a generally parallel orientation with respect to the major blade portion 54 by link 78 and blade support bracket 71 which are pivotally retained by pins 77 and 79, respectively, as shown in FIG. 1. The piston end 82 of the reversing cylinder, also shown in FIGS. 4A–4C below, is pivotally connected by pins 83 to two brackets 84 mounted to the rear of the blade major portion 52 to transfer the force provided to move the trip edge 54 by the reversing cylinder.

Figure 2:
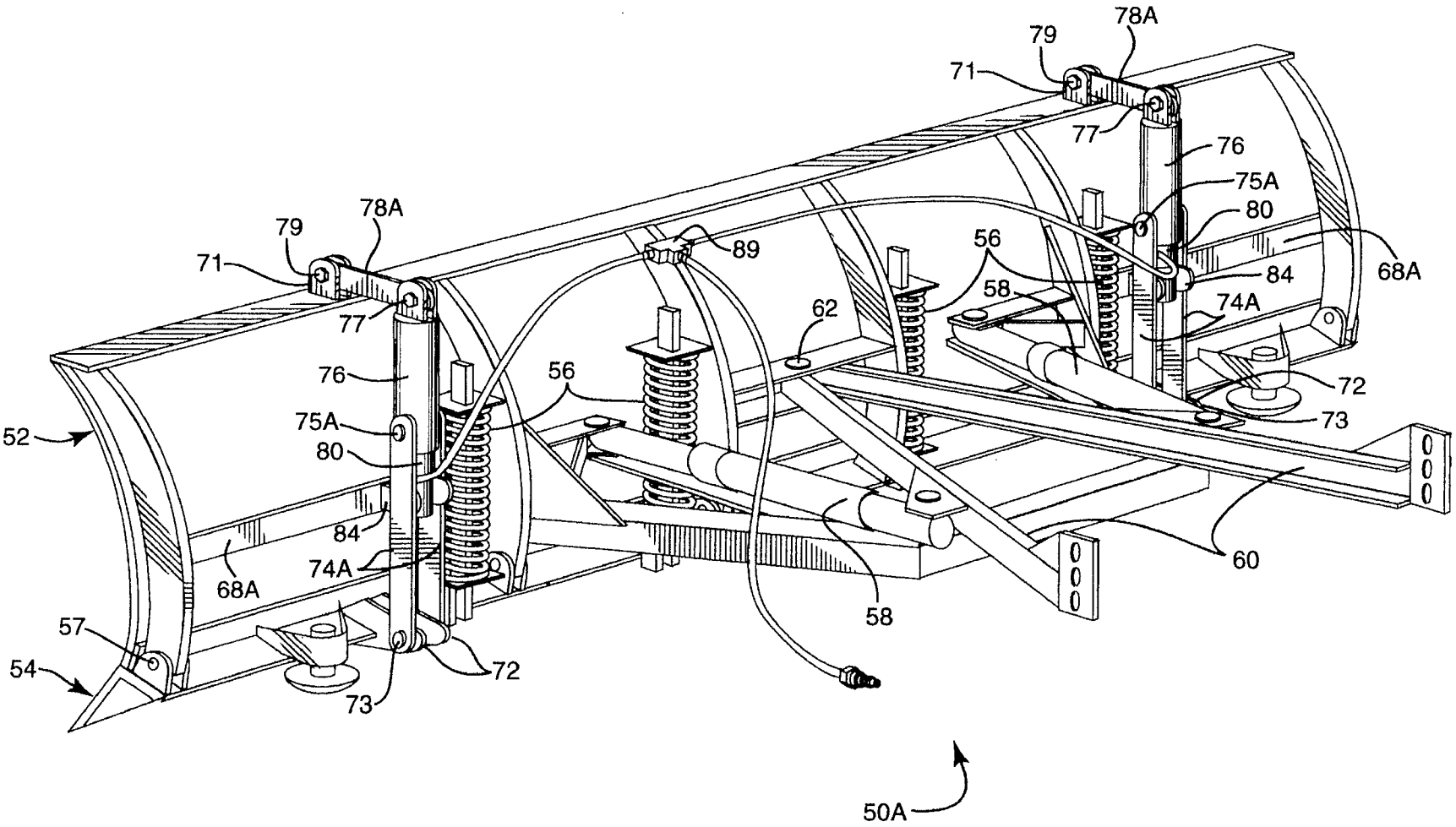
FIG. 2 is a rear elevation of a plow according to one embodiment of the present invention having two reversing cylinders.

An alternate embodiment 50A of the present invention is shown in FIG. 2, wherein the plow is extended in width, and two sets of linkages and cylinders, as described with reference to FIG. 1, are provided. As shown in FIG. 2, the additional cylinders and linkages are mounted symmetrically on the plow and located to distribute the forces applied to the blade portions, and to accommodate the structural features and/or limitations of the particular plow blade used. The two reversing cylinders are connected to be powered simultaneously via a tee 89 which receives hydraulic fluid pressure from the appropriate source as described in the hydraulic circuits of FIGS. 5 and 6, below. Adaptation of the present invention to blades of further extensions in width with additional sets of linkages and cylinders are within the scope of the present invention.

Figure 3:
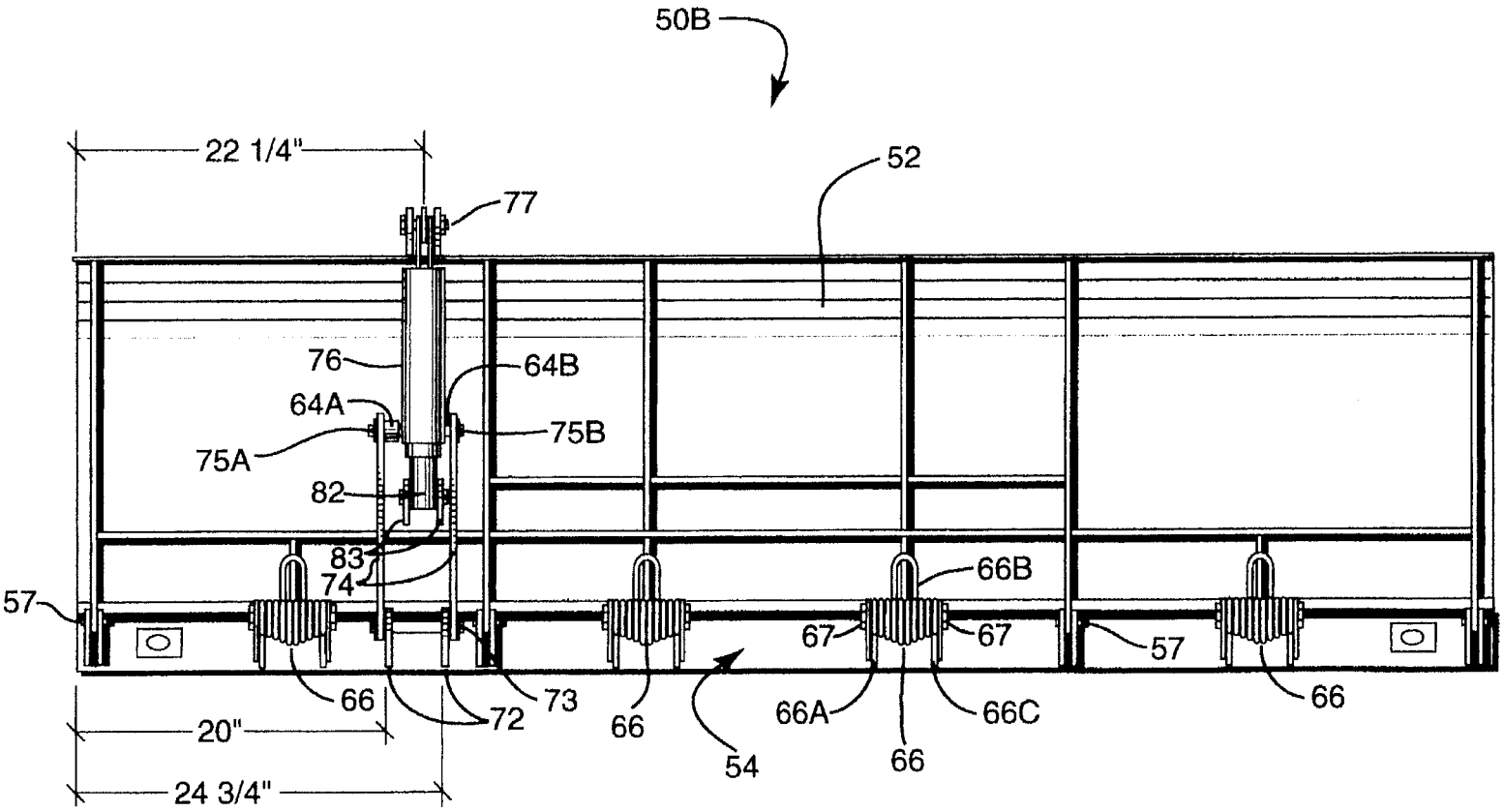
FIG. 3 is a rear elevation of a plow according to one embodiment of the present invention having torsion trip springs.

A further alternate embodiment 50B is shown in FIG. 3, wherein a single cylinder and set of linkages is applied to a plow having torsional springs 66 which urge the front surface of the trip edge 54 to form the desired concave surface with the major blade portion 52 in the normal, untripped mode. The torsional springs 66 are mounted about the pivot pin 67 and apply a rotational force, relative to the major blade portion, against the trip edge 54 and the major portion 52 of the blade by the ends 66A, 66B and 66C. A further feature applicable to all embodiments shown, provides unequal length pins and corresponding unequal length spacers 64A and 64B provide an additional distance between links 74 and one side of the cylinder 76 to permit unrestricted access to the fluid coupling fittings (84 shown in FIG. 5, below) of the reversing cylinder 80 as necessitated by the particular cylinder used. The reversing cylinder used is part no. B25200 manufactured by Buyers, of Mintor, Ohio other equivalent parts may be used with structural modifications as appropriate.

Figures 4A, 4B, 4C:
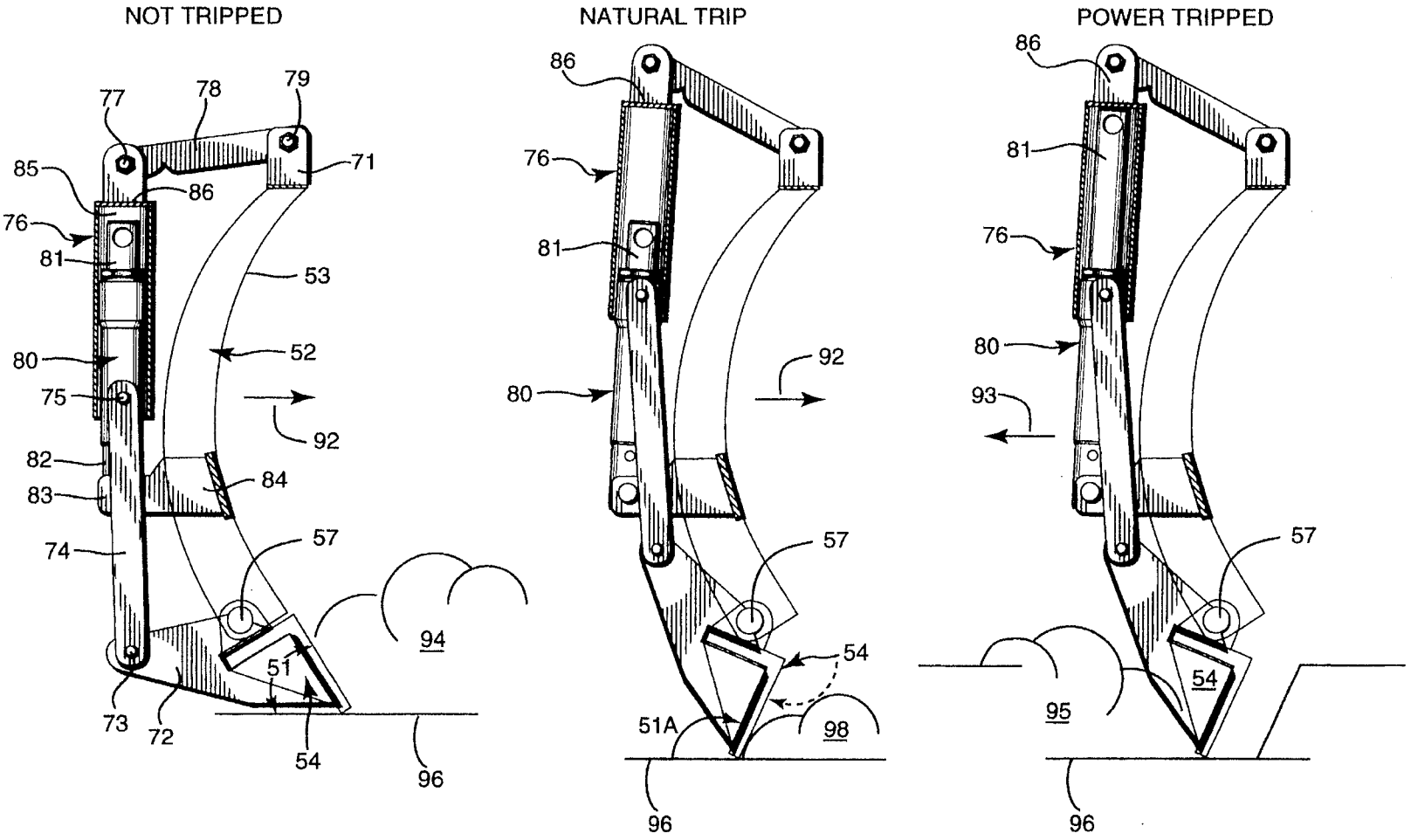
FIGS. 4A, 4B and 4C are side elevation drawings of one embodiment of the present invention showing the not tripped, selectively (power) tripped and obstacle (natural trip) modes.

A more detailed side elevation view of each of the three modes of operation of the preferred embodiment of the present invention is shown in FIGS. 4A, 4B and 4C. The springs 56 and other general structural elements have been omitted for clarity. A 'reversing' hydraulic cylinder 80 is freely movable within the length of the cylinder 76, which is attached by links 74 and 72 to move the trip edge 54 from the normal forward position into the tripped position (of FIG. 4C) or selectively into any intermediate position. However, as the piston end 81 of the hydraulic cylinder 80 is not extended and may or may not be contacting the top 86 of the cylinder 76, the trip edge 54 remains in the forward, untripped position. Thus, when moving in a forward direction 92, material 94 is moved on the surface 96.

When the plow and trip edge encounters an obstacle 98, the resiliently pivoted trip edge moves about the pivot pins 57 into a rearward position forming an angle with the surface behind the plow of greater than 90°, thus allowing the plow to pass over the obstacle 98 with reduced force. In so doing, linkages 72 and 74 lift the cylinder 76, further separating the top of the piston end 81 from the top of the cylinder 86. The link 78 and the bracket 71 maintain the orientation of the cylinder 76 and the reversing cylinder 80 to an upright position, generally parallel to the front of the plow blade. In this mode, the operation of the springs 56 to urge the blade into the forward position and the movement of the trip edge in response to the object 98 is not inhibited by the structure according to this embodiment of the present invention.

When operated in the reverse direction 93 and plowing or grading in the reverse direction is desired, the hydraulic cylinder 80 is actuated, causing the piston end 81 to extend, lifting the cylinder 76, and in turn, causing links 74 and 72 to move the trip edge 54 about the pivot pins 57 into a reverse position, providing an angle with the surface 96 of greater than 90 degrees. The reversed trip edge 54 can now effectively move material 95 from the surface 96 when the plow is moved in a reverse direction 93. The bracket 71 and link 78 maintains the orientation of the cylinder 76 and the reversing cylinder 80 in a generally upright position wherein its axis extends along a line substantially the same as the axis of the cylinder when the piston 81 is unextended.

Figure 5:
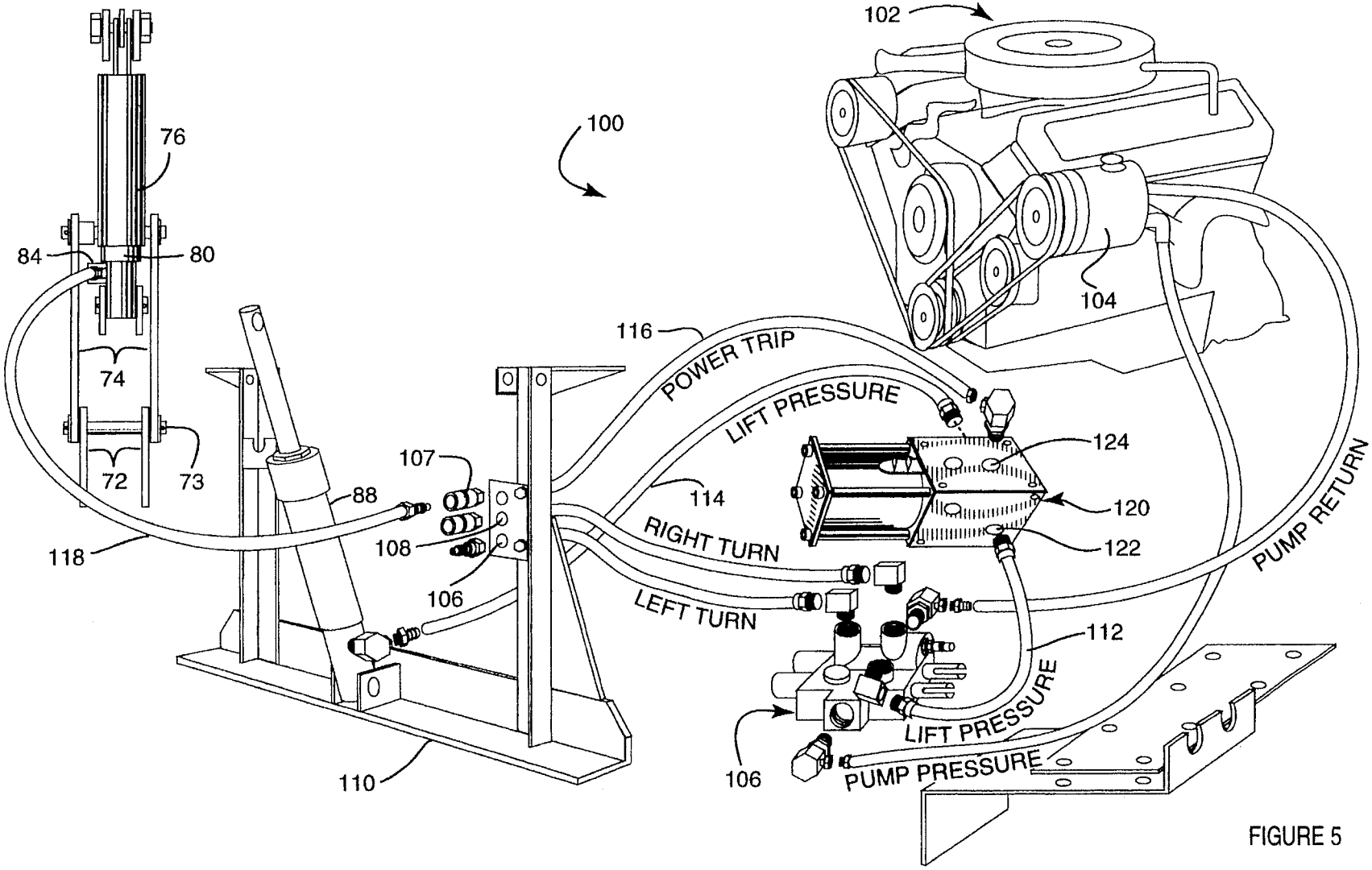
FIG. 5 is a diagram of the plow hydraulic system according to one embodiment of the present invention used with an engine-powered hydraulic pump.

The simplified hydraulic circuit 100 of one embodiment of the present invention is shown in FIG. 5, wherein the existing system of an engine 102 powered plow is modified to selectively power the reversing cylinder 80. As shown in FIG. 5, the hydraulic pump 104 provides pressure to a plow control valve 106, typical to plow hydraulic systems, which in turn powers the left/right control cylinders (e.g. 58 of FIG. 2) via couplings 106 and 108 typically "quick connectors" attached to the plow support 110 which is in turn attached to the frame of the vehicle (not shown). The plow control valve 106 also selectively provides lift pressure to the lift cylinder 88 which raises and lowers the plow blade assembly. According to one embodiment of the present invention, the lift pressure line first connects to a diverter valve 120, such as hydraulic selector valve part no. MS06-UDNA-01, made by Gresen, Sarasota Fla., or equivalent, which is electrically controlled by an appropriate source, e.g. car battery and auxiliary electrical switch, to allow the pressure to flow from an input port 122 to at least one of two output ports in response to an electrical signal applied. In the non-energized mode, the normally open output port of the diverter valve is connected to the line 114 which is connected to the lift cylinder 88, so that all normal plow operations are controllable by the control valve 106. The other, normally closed output port 124 is connected to the reversing cylinder 80 via lines 116 and 118 and fitting (quick connector) 107, so that when the diverter cylinder is electrically activated, pressure is applied to the reversing cylinder 80 via diverter valve 120 when the lift pressure is applied by control valve 106. As the lift pressure can typically be supplied in varying amounts and durations, the present invention can provide a full range of trip edge positions from the normal acute angle to a full reverse angle, and any intermediate angle. After the trip edge is satisfactorily positioned, the diverter valve 120 is deactivated locking the oil in for the reversing cylinder and permitting the plow positioning operation to return to normal operations. To release the trip edge back into the untripped (normal) position, reactivate the diverter valve 120 and operate the appropriate lift (or left/right control for electric hydraulic plows, below) to release the reversing cylinder pressure, and deactivate the reversing cylinder.

Figure 6:
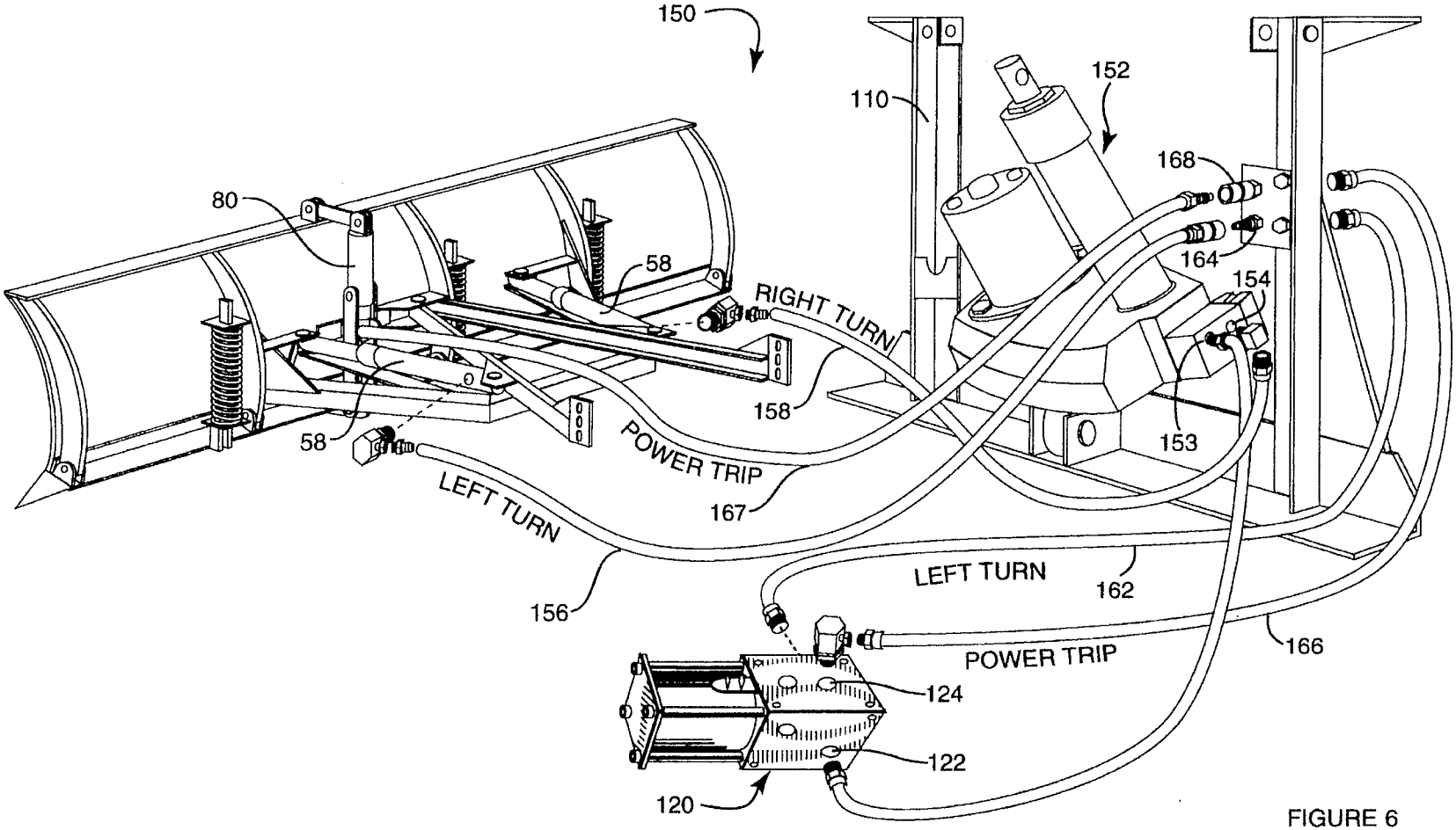
FIG. 6 is a diagram of the plow hydraulic system according to one embodiment of the present invention used with an electric motor powered hydraulic pump.

An alternate embodiment of the present invention 150 shown in FIG. 6 as applied to an electric hydraulic powered plow such as model no. 7740 sold by Fisher Engr., Rockland, Me., which typically includes an integrated electric motor driven hydraulic pump/control valve/lift cylinder assembly 152 which selectively provides left/right hydraulic pressures to the respective cylinders 58 via hydraulic lines 156 and 158 via output ports 153 and 154 according to appropriate mechanical and/or electrical control signals. According to an alternate embodiment of the present invention, the left pressure output port is connected to the input port 122 of the diverter valve 120, and the normally open (when unactuated) output port is connected to the left turn cylinder line 156 via line 162 and connector 164. The normally closed (open when actuated) output port 124 is connected to the reversing cylinder 80 via lines 166 and 167 and connector 168. Thus, according to this embodiment of the present invention, the reversing cylinder is selectively actuated by activating the diverter valve and applying a left turn control to the assembly 152.

Figure 7:
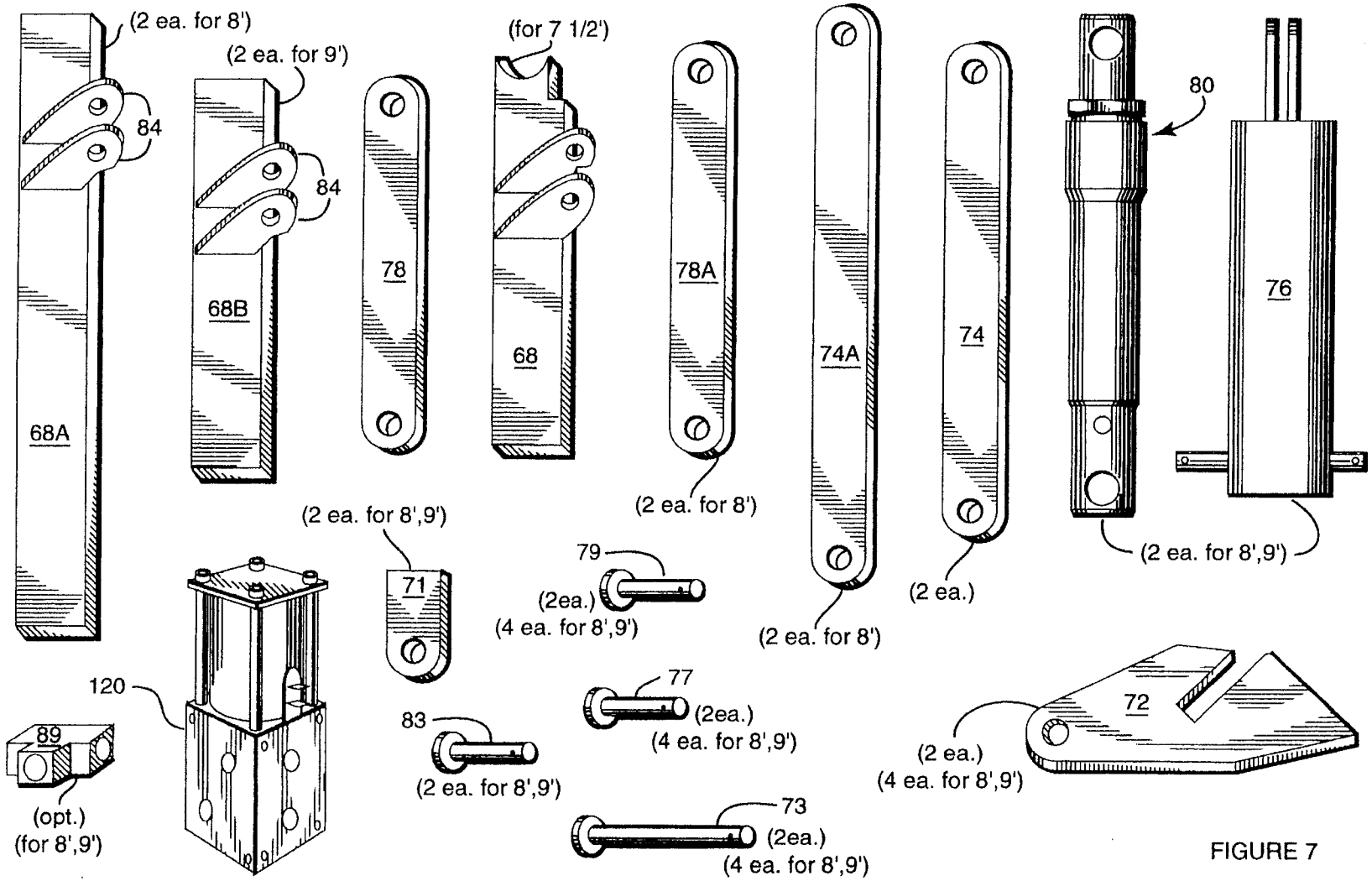
FIG. 7 is a plan view of individual elements of one embodiment or the present invention provided as a kit.

A further embodiment of the present invention comprises a kit of parts 180, such as illustrated in FIG. 7, which when applied to an existing snowplow according to the teaching of the present invention, provides the features thereof. The kit 180 shows the single unit representations elements for the typical 7½' plow, and alternate components for the 8' and 9' plow are indicated. Typically included are the linkages 74 (or 74A), 78 (or 78A); pins 73, 77, 79; brackets 71, 72 and 84, supports 68 with brackets 84 (or supports 68A with brackets 84); pins 73, 77, 79; optional hydraulic tee 89; reversing cylinder(s) 80; diverter valve 120; and other, miscellaneous items such as wire, an electrical switch, a fuse, hydraulic lines (hoses), mounting plates and brackets (as needed) etc., not shown. As some of the included elements require attachment to existing plow or plow blade structures, such attachment is provided by welding, brazing or other methods as appropriate. Moreover, while the illustrated adaptation of snow plows shown herein relate to Fisher model nos. 7761, 7657, 7658 and 7659 for the 7', 7½', 8' and 9' plows, and various models of Diamond Equipment Inc., of Lewiston, Me., the present invention is applicable to other plow and plow blade assemblies by one of ordinary skill in the art.

These and further modifications and substitutions by one of ordinary skill in the art are considered to be within the scope of the present invention, which is not to be limited except by the following claims.

What is claimed is:

1. A plow blade assembly, comprising:

a main blade mounted on a vehicle and selectably movable thereon according to selective energization of at least one of a left/right plow cylinder and a plow blade lift cylinder, said main blade having a major dimension extending laterally parallel to a surface to which the plow is applied;

a plow position control means selectively providing fluid pressure to at least one of said left/right plow cylinder and said plow lift cylinder and including corresponding selectively powered hydraulic lines normally connected to the respective said left/right and plow lift cylinders;

a secondary blade disposed between the main blade and said surface, and being pivotally mounted on said main blade along an edge of said major dimension, said secondary blade having a first position associated with a forward motion of said main blade along a direction perpendicular to said major dimension and along said surface, and having a second position associated with a reverse motion of said main blade along a direction perpendicular to said major dimension and along said surface opposite said forward direction;

resilient means for urging said secondary blade into said first position; and means for selectively moving said secondary blade into said second position, wherein said means for selectively moving further includes a diverter valve connected to interrupt one of said selectively powered hydraulic lines and divert the hydraulic pressure to a hydraulic cylinder connected to said secondary blade, and wherein said selectively powered hydraulic lines is a hydraulic line connected to one of a left/right plow cylinder and a plow blade lift cylinder.

2. The plow blade assembly of claim 1, wherein said means for selectively moving includes means for moving said secondary blade into a selected position between said first and said second position.

3. The plow blade assembly of claim 1, wherein the means for selectively moving comprises a hydraulic cylinder having a controllable extension and at least one link member for transferring the hydraulic cylinder extension to said main blade and said secondary blade to effect moving said secondary blade into said second position.

4. The plow blade assembly of claim 3, wherein said means for selectively moving further includes a diverter valve connected to interrupt a selectively powered hydraulic line and divert the hydraulic pressure to said hydraulic cylinder.

5. The plow blade assembly of claim 4, wherein said diverter valve is electrically actuated, said plow blade assembly further including an electric switch connected to said diverter valve and an electric power source to selectively actuate said diverter valve.

6. The plow blade assembly of claim 3, further including a plurality of hydraulic cylinders disposed along the width of said plow blade assembly and connected to be simultaneously actuated.

7. The plow blade assembly of claim 4, wherein said selectively powered hydraulic line is a line connected to a plow blade lift cylinder.

8. The plow blade assembly of claim 4, wherein said selectively powered hydraulic line is a line connected to a left/right plow cylinder.

9. The plow blade assembly of claim 1, wherein said resilient means for urging comprises one of a compression spring and a torsion spring.

10. A kit for adapting a snowplow having a primary blade and a resiliently positioned secondary blade interposed between said primary blade and a surface to which the snowplow is applied and resiliently positioned relative to said primary blade in a first position, comprising:

means for imparting a force along a first direction along a path and movable away from said secondary blade along said path and having a first element and a first rigid link for pivotally connecting said first element to said primary blade, said means for imparting a force including a second element movable along said path; and means for coupling the force applied along said first direction from said second element to said secondary blade comprising a second rigid link, to cause said resiliently positioned blade to move out of said first position, wherein said first rigid link aligns said means for imparting a force to receive a load resulting from said force substantially along said path.

11. The kit of claim 10, wherein said means for imparting a force comprises a hydraulic cylinder.

12. The kit of claim 10, further including a diverter valve connected to interrupt a selectively powered hydraulic line and divert the hydraulic pressure to said hydraulic cylinder.

13. The plow blade assembly of claim 12, wherein said diverter valve is electrically actuated, said kit further including an electric switch connected to said diverter valve and an electric power source to selectively actuate said diverter valve.

14. The kit of claim 11, wherein said means for coupling the force comprises means for coupling force applied in a first direction, being uncoupled in the direction opposite said first direction to cause said secondary blade to move out of said first position into a second position when said hydraulic cylinder is actuated, and not inhibiting the movement of said secondary blade out of said first position when not actuated.

15. A plow blade assembly, comprising:

a main blade having a major dimension extending laterally parallel to a surface to which the plow is applied;

a secondary blade disposed between the main blade and said surface, and being pivotally mounted on said main blade along an edge of said major dimension, said secondary blade having a first position associated with a forward motion of said main blade along a direction perpendicular to said major dimension and along said surface, and having a second position associated with a reverse motion of said main blade along a direction perpendicular to said major dimension and along said surface opposite said forward direction;

resilient means for urging said secondary blade into said first position; and means for selectively moving said secondary blade into said second position, including an actuator means having a first element pivotally connected to said main blade by a first rigid link and movable away from said secondary blade along a path and a second element selectably movable relative to said first element along said path, said second element being connected to said secondary blade by a second rigid link and imparting a unidirectional force thereon to move said secondary blade into said second position, wherein said first rigid link aligns said actuator to receive a load corresponding to said force substantially along said path.

16. The plow blade assembly according to claim 15, wherein said secondary blade is movable about an axis, and said means for selectively moving imparts said force substantially perpendicular to said secondary blade axis.

* * * * *